United States Patent [19]

Bianchetta

[11] 4,210,061

[45] Jul. 1, 1980

[54] THREE-CIRCUIT FLUID SYSTEM HAVING CONTROLLED FLUID COMBINING

[75] Inventor: Donald L. Bianchetta, Coal City, Ill.

[73] Assignee: Caterpillar Tractor Co., Peoria, Ill.

[21] Appl. No.: 956,169

[22] Filed: Oct. 30, 1978

Related U.S. Application Data

[63] Continuation of Ser. No. 746,978, Dec. 2, 1976, abandoned.

[51] Int. Cl.[2] ..... F01B 25/02

[52] U.S. Cl. ..... 91/6; 60/484; 60/486; 91/521; 91/531

[58] Field of Search ..... 91/6, 521, 522, 526, 91/527, 531; 60/484, 486

[56] References Cited

U.S. PATENT DOCUMENTS

| | | | |
|---|---|---|---|
| 3,208,221 | 9/1965 | Schuetz . | |
| 3,720,059 | 3/1973 | Schurawski | 60/421 |
| 3,922,855 | 12/1975 | Bridwell | 60/421 |
| 4,024,797 | 5/1977 | Johnson | 91/451 |

FOREIGN PATENT DOCUMENTS

| | | | |
|---|---|---|---|
| 648962 | 11/1962 | Italy | 91/527 |

*Primary Examiner*—Abraham Hershkovitz
*Attorney, Agent, or Firm*—John W. Grant

[57] ABSTRACT

A three-circuit fluid system has at least one work element served by a pressurized fluid source and a plurality of work elements connected in interruptible series in each of the second and third circuits. A control system is provided for selectively diverting excess fluid from the pressurized fluid source of the first circuit to the second and third circuits in one mode of the control system and diverting excess fluid from the pressurized fluid source of the first circuit to only preselected work elements of the second and third circuits in a preselected order in another mode of the control system.

13 Claims, 1 Drawing Figure

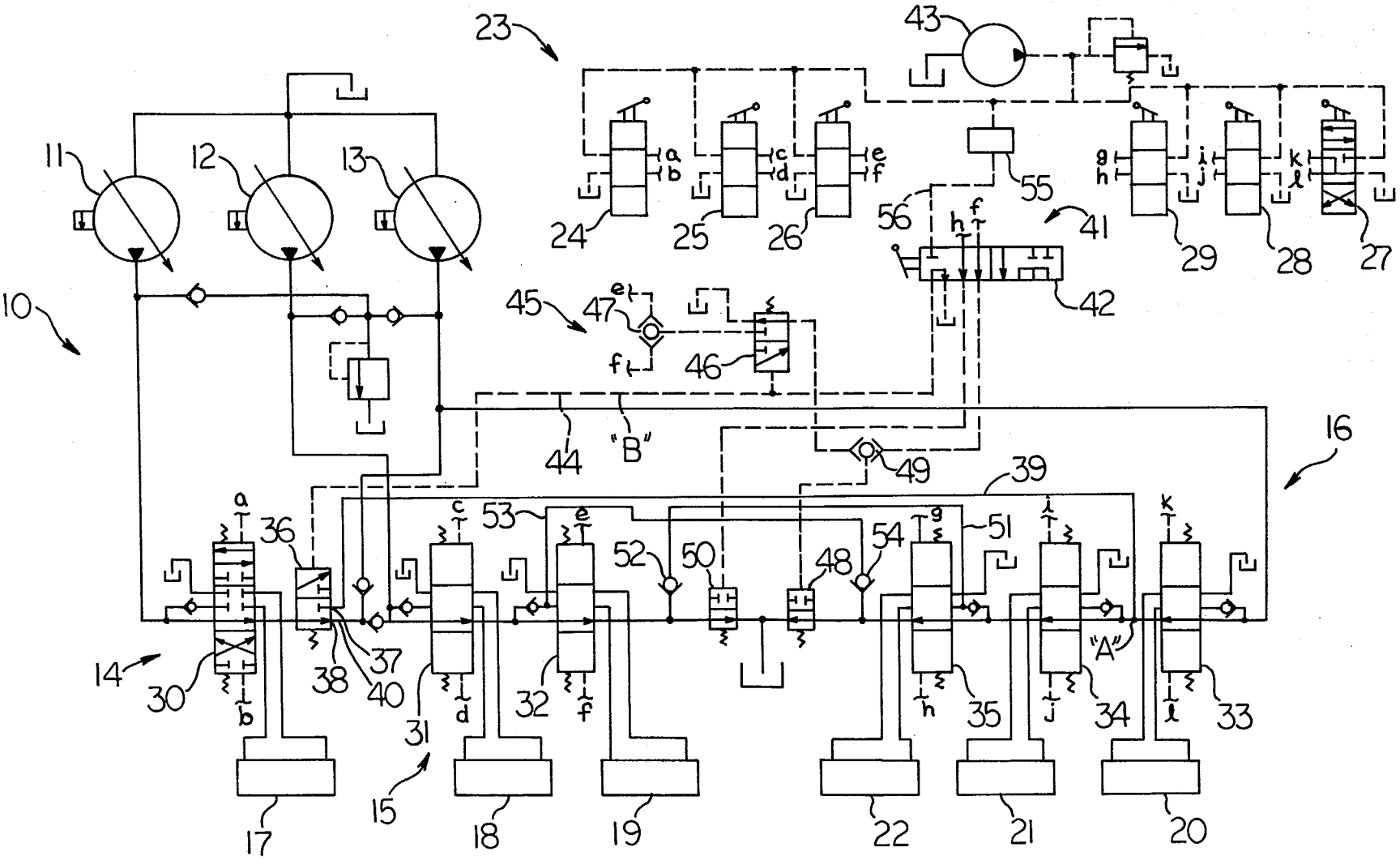
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
"A"
"B"

THREE-CIRCUIT FLUID SYSTEM HAVING CONTROLLED FLUID COMBINING

This is a continuation, of Ser. No. 746,978, filed Dec. 2, 1976 now abandoned.

BACKGROUND OF THE INVENTION

In fluid systems having a plurality of work elements, for example in an excavator having a plurality of pumps serving respective work elements through separate circuits, it is desirable to provide controls for providing fluid to the work elements in a preselected order, controllably combining fluid in a preselected order between the circuits, and controllably increasing the fluid available to preselected work elements during preselected modes of operation of the excavator.

By providing the controls of this invention, the excavator has increased versatility and efficiency and the waste of materials, power, and time is reduced.

According to the present invention, a fluid system has at least one pressurized fluid source serving a respective first, second, and third fluid circuit. The first circuit has a first work element and the second and third circuits each have a plurality of work elements connected in interruptible series. Means are connected to each respective work element for selectively, controllably passing fluid to and from the work elements. A selecting means has a selecting element that is movable between first and second positions. At the first position of the selecting element, excess fluid delivered by the first pump to the first circuit is diverted to the second and third circuits. At the second position of the selecting element, excess fluid delivered to the first circuit is diverted to preselected work elements.

BRIEF DESCRIPTION OF THE DRAWING

The drawing is a diagrammatic view of the fluid system of this invention.

DETAILED DESCRIPTION OF THE INVENTION

Referring to the drawing, a fluid system 10 of an excavator, for example, has first, second, and third pumps 11,12,13 each controllably supplying fluid to a respective first, second, and third circuit 14,15,16.

The first circuit 14 has at least one work element served by pump 11, for example first work element 17, which, for purposes of illustration, is a swing drive.

The second circuit 15 has a plurality of work elements served by pump 12, for example second work element 18 and third work element 19. The third circuit 16 has a plurality of work elements served by pump 13, for example fourth work element 20, fifth work element 21, and sixth work element 22.

For illustration purposes, the second work element 18 is a left track apparatus, the third work element 19 is a stick apparatus, the fourth work element 20 is a right track apparatus, the fifth work element 21 is a bucket apparatus, and the sixth work element 22 is a boom apparatus. However, these work elements can be different without departing from this invention.

The work elements 18,19 and 20–22 of the respective second and third circuits 15,16 are connected in their respective circuits in interruptible series, as is known in the art, for passing fluid through the work elements of each circuit in a preselected order. For illustration purposes, that order of each circuit is in the numerical order of the work elements of the particular circuit.

Means 23 is connected to each work element for selectively, controllably passing fluid to and from said work element. The means 23 are first, second, third, fourth, fifth, and sixth controlling valves 24–29 connected to a respective actuating valve 30–35 of a respective work element 17–22.

A diverting valve 36 has first and second outlets 37,38 and has its inlet connected in the first circuit 14 at a location downstream of the first actuating valve 30 of the first working element 17. A first conduit 39 is connected at one end to the first outlet 37 of the diverting valve 36 and at the other end to the third fluid circuit 16 at a preselected location "A". A second conduit 40 is connected at one end to the second outlet 38 of the diverting valve 36 and at the other end to the second and third circuits 15,16 at locations between the respective second and third pumps 12,13 and their associated work elements 18,19 and 20–22.

A selecting means 41 having a selecting element 42 is provided in the fluid system 10. The selecting element 42 is movable between a first position (shown) at which excess fluid delivered by the first pump 11 to the first circuit 14 is diverted to the second and/or third circuits 15,16 and a second position at which the excess fluid delivered by the first pump 11 to the first circuit 14 is diverted to only preselected work elements of the second and third circuits in a preselected order. For example, the order of said work elements is bucket 21, thereafter boom 22, and thereafter stick 19.

The selecting element 42 is connected to a pilot pump 43 and preselected ones of the controlling valves, 26,27, for example. A third conduit 44 is connected to the selecting element 42 and to the diverting valve 36 for selectively passing a pilot signal "B" to the diverting valve 36 in response to the position of the selecting element for selectively diverting fluid by said diverting valve 36.

The pilot signal passing from pilot pump 43 to selecting element 42 can preferably be further controlled by positioning a valve 55 in the line 56 which delivers pilot pressure from the pilot pump 43 to the selecting element 42. In such a system, the valve 55 can be a portion of a vehicle brake system and constructed for passing pilot pressure to the selecting element 42 in response to the brake being inactivated and interrupting the pilot pressure to the selecting element in response to the brake being actuated.

Means 45 is associated with the third conduit, the selecting element 42 and a preselected controlling valve, for example controlling valve 26, for controllably connecting the second and third circuits 15,16 in response to the position of the selecting element and the position of said controlling valve 26.

As can be seen by a study of the drawing, means 45 comprises valve 46, resolver 47, blocker valves 48,50, resolver 49, and associated bypass lines and elements. Valve 46 is connected to control valve 26 via resolver 47, selecting element 42, via conduit 44 and a blocker valve 48, via resolver 49, at the downstream end of the third circuit 16. Blocker valve 50 is positioned at the downstream end of the second circuit 15 and is connected to the sixth controlling valve 29 via selecting element 42.

Bypass line 51 is connected at one end of the second circuit 15 at a location between blocker valve 50 and work element 19 and at the other end to the third circuit 16 at a location between the fifth and sixth work elements 21,22. The direction of flow in line 51 is maintained from the second circuit 15 to the third circuit 16 by check 52.

Bypass line 53 is connected at one end to the third circuit 16 at a location between blocker valve 48 and work element 22, and at the other end to the second circuit 15 at a location between work elements 18 and 19. The direction of flow in line 53 is maintained from the third circuit 16 to the second circuit 15 by check 54.

In the first position of the selecting element 42, pilot pressure is blocked from valve 46 and directing valve 36 and said valves 36,46 are in the positions shown. Fluid from the first pump 11 supplies the swing 17 and any excess fluid is delivered through valve 36 into line 40 for use by the second and/or third circuits 15,16. Fluid from the second pump 12 is delivered to the left track 18. Any excess fluid from the left track 18 thereafter passes to the stick 19 and any excess fluid from the stick 19 passes through line 51 to the boom 22 when the boom is being used, for example. Fluid from the third pump 13 passes to the right track 20. Any excess fluid from the right track 20 thereafter passes to the bucket 21, any excess fluid from the bucket 21 thereafter passes to the boom 22, and any excess fluid from the boom 22 passes to the stick 19 via line 53 when the stick 19 is being used, for example. Therefore, a fluid pathway is provided from each of the pumps 11,12,13 to a preselected one of the work elements of one of the circuits, here the sixth work element 22 of third circuit 16 or the third work element 19 of the second circuit 15.

In the second position of the selecting element 42, pilot pressure is delivered through the selecting element 42 to valves 36 and 46 which causes these valves to divert fluid delivered thereto.

Fluid from the first pump 11 is delivered to the swing 17, excess fluid from the swing 17 is thereafter delivered to the bucket 21 via line 39, excess fluid from the bucket 21 is thereafter delivered to the boom 22, and excess fluid from the boom 22 is thereafter delivered to the stick 19, via line 53 when the stick 19 is being used, for example. Fluid from the second pump 12 is delivered to the left track 18, and excess fluid from the left track 18 is thereafter delivered to the stick 19. Fluid from the third pump 13 is delivered to the right track 20, excess fluid from the right track 20 is thereafter delivered to the bucket 21, and excess fluid from the bucket 21 is thereafter delivered to the boom 22, and any excess fluid from boom 22 is delivered to stick 19 via line 53 when the stick 19 is being used, for example.

As apparent in the drawing, when the second and third circuits are supplying fluid to work elements not in their respective circuit, their respective blocker valves 50, 48 are in the blocked position in order to terminate excess flow from the circuit to tank and pass said excess fluid into the respective bypass line 51,53. Here these blocking valves 48,50 are movable in response to the position of the respective controlling valves 26,29 of the stick 19 and boom 22.

Therefore, by this construction, the fluid system cannot only selectively combine fluid from the various pumps but can also control the order of work elements to which the fluids are delivered thereby increasing the versatility of the system and changing the speed of operation of selected work elements under certain conditions.

Other aspects, objects, and advantages of this invention can be obtained from a study of the drawings, the disclosure, and the appended claims.

The embodiments of the invention in which an exclusive property or privilege is claimed are defined as follows:

1. In a fluid system having at least one pressurized fluid source serving a first, second, and third fluid circuit, said first circuit having a work element and each of said second and third circuits each having a plurality of work elements and control means connected to each respective work element for selectively, controllably passing fluid to and from said work element, said control means of each of said second and third circuits being connected in interruptible series with the control means of the same circuit, the improvement comprising:

delivering means for delivering excess fluid from the third circuit to a preselected work element of the second circuit in response to actuation of said control means connected to said preselected work element; and diverting means movable between a first position at which excess fluid delivered from the fluid source to the first circuit is delivered to the second and third circuits and a second position at which excess fluid delivered to the first circuit is diverted to only preselected work elements of the third circuit and said delivering means in a preselected order.

2. The fluid system of claim 1 including a plurality of pressurized fluid sources each connected to a respective one of said first, second, and third circuits.

3. The fluid system of claim 1 wherein said diverting means includes a diverting valve connected to said first circuit downstream of said control means of said first circuit, a first conduit connecting said diverting valve to said third circuit upstream of said control means connected to said preselected work elements of the third circuit, and a second conduit connecting the diverting valve to the second and third circuits upstream of said control means connected to said second and third circuits.

4. The fluid system of claim 3 including a reservoir and wherein said delivering means includes a blocker valve movable between a first position at which said third circuit is in communication with said reservoir and a second position at which communication between the third circuit and the reservoir is blocked, and a conduit connected to said third circuit upstream of said blocker valve and to said second circuit upstream of said control means connected to said preselected work element of said second circuit.

5. The fluid system of claim 4 including a selecting valve movable between a first position for conditioning the diverting valve into its first position and the blocker valve into its first or second position as determined by the control means connected to the preselected work element of the second circuit, and a second position for conditioning the diverting valve into its second position, and means for conditioning the blocker valve into its second position at the second position of the selecting valve in response to actuation of the control means connected to the preselected work element of the second circuit.

6. The fluid circuit of claim 5 wherein said means for conditioning the blocker valve includes a first resolver connected to the control means connected to the preselected work element of the second circuit, a second resolver connected to said selecting valve and to said blocker valve, a valve connected to both first and second resolvers and movable to a first position at which the output of said first resolver is blocked and a second position at which the output of said first resolver is delivered to said second resolver, said valve being movable to its second position in response to movement of said selecting valve to its second position.

7. The fluid system of claim 1 including a plurality of pressurized fluid sources each connected to a respective one of said first, second, and third circuits, and wherein at the first position of said diverting means a fluid pathway is provided from each of the pressurized fluid sources to a preselected one of the work elements of one of said second and third circuits.

8. The fluid system of claim 7 wherein said preselected work element having a fluid pathway from each of the pressurized fluid sources is positioned in said second circuit.

9. The fluid system of claim 1 wherein the first circuit has a first work element, the second circuit has a second work element and a third work element, and the third circuit has a fourth work element, a fifth work element, and a sixth work element, said control means has first, second, third, fourth, fifth, and sixth control valves connected to the first, second, third fourth, fifth, and sixth work elements respectively.

10. The fluid system of claim 9 wherein there are a plurality of pressurized fluid sources each connected to a respective one of the first, second, and third circuits, and wherein fluid passes from the pressurized fluid sources through the respective control valves of the respective circuits in numerical order of the control valves of said respective circuit and wherein the diverting means at the second position provides a fluid pathway from the pressurized fluid source connected to said first circuit into the first control valve, from the first control valve to the fifth control valve, from the fifth control valve to the sixth control valve, and from the sixth control valve to the third control valve.

11. The fluid system of claim 10 wherein said diverting means at the first position thereof provides a fluid pathway in the third circuit in the preselected order of from said pressurized fluid source connected to said first control valve to the fourth control valve, from the fourth control valve to the fifth control valve, from the fifth control valve to the sixth control valve, and from the sixth control valve to the third control valve.

12. The fluid system of claim 11 including means for delivering excess fluid from said second circuit to said sixth control valve in response to actuation of said third control valve.

13. In a fluid system having a first pressurized fluid source serving a first circuit, a second pressurized fluid source serving a second circuit, a third pressurized fluid source serving a third circuit, said first circuit having a work element and each of said second and third circuits each having a plurality of work elements, and a separate control valve connected to each work element for selectively, controllably passing fluid to and from said work element, said control valves of each of said second and third circuit being connected in interruptible series with the control valve of the same circuit, the improvement comprising:

a diverting valve having first and second outlets and being connected to the first circuit at a location downstream of the control valve of the first circuit, said diverting valve being movable between a first position at which excess fluid from the first circuit is directed to the second outlet and a second position at which excess fluid from the first circuit is directed to the first outlet;

a first conduit connecting the first outlet of the diverting valve to the third circuit at a preselected location;

a second conduit connecting the second outlet of the diverting valve with the second and third circuits at locations upstream of the respective control valves of said second and third circuits;

a selecting element movable between first and second positions;

a pilot pump connected to the selecting element;

a third conduit connected to the selecting element and the diverting valve for selectively passing a pilot signal to the diverting valve in response to the selecting element moving to the second position for selectively actuating the diverting valve to the second position and diverting fluid from the first circuit to the second conduit;

means for connecting a preselected one of the control valves to the selecting element; and means associated with the third conduit, the selecting element, and the preselected one of the control valves for controllably communicating the second and third circuits in response to the selecting element moving to the second position and actuation of the preselected one of the control valves.

* * * * *